United States Patent [19]

Wood

[11] 4,001,981

[45] Jan. 11, 1977

[54] ABRASIVE ARTICLE

[75] Inventor: Everitt Franklin Wood, West Chester, Pa.

[73] Assignee: E. I. Du Pont de Nemours and Company, Wilmington, Del.

[22] Filed: June 26, 1975

[21] Appl. No.: 590,495

Related U.S. Application Data

[63] Continuation of Ser. No. 443,205, Feb. 19, 1974, abandoned.

[52] U.S. Cl. ..... 51/209 R; 51/298 A

[51] Int. Cl.[2] ..... B24D 7/02

[58] Field of Search ..... 51/296, 298, 209 R, 51/206 R, 204

[56] References Cited

UNITED STATES PATENTS

| | | | |
|---|---|---|---|
| 2,734,812 | 2/1956 | Robie | 51/298 |
| 3,117,400 | 1/1964 | Martin | 51/209 R |
| 3,179,631 | 4/1965 | Endrey | 51/298 U X |
| 3,261,811 | 7/1966 | Tatum | 51/298 X |
| 3,329,488 | 7/1967 | Cofran | 51/296 |
| 3,377,411 | 4/1968 | Charvat | 51/298 X |
| 3,383,191 | 5/1968 | Thomas | 51/298 |
| 3,385,684 | 5/1968 | Voter | 51/298 |
| 3,523,773 | 8/1970 | Sears | 51/298 |
| 3,718,447 | 2/1973 | Hibbs | 51/298 X |
| 3,883,452 | 5/1975 | Scheverlein et al. | 51/298 X |

*Primary Examiner*—Al Lawrence Smith
*Assistant Examiner*—K. J. Ramsey

[57] ABSTRACT

An abrasive article such as a cup-shaped grinding wheel is provided, said grinding wheel having a cup-shaped support member of a cross-section providing an annular support surface to which is secured an annular abrasive member consisting of an annular polyimide resin-bonded diamond abrasive member and an annular back-up member of abradable porous polyimide secured to the inside surface of the annular polyimide bonded diamond abrasive member; the porous polyimide back-up member wears away in use and therefore obviates the need for dressing the grinding wheel.

3 Claims, 2 Drawing Figures

ABRASIVE ARTICLE

This is a continuation of application Ser. No. 443,205 filed Feb. 19, 1974, now abandoned.

FIELD OF THE INVENTION

The present invention relates to abrasive articles and, more particularly, is directed to novel abrasive tools such as grinding wheels having a resin-bonded abrasive particle-containing member secured to a support member.

The present invention is applicable to abrasive articles such as peripheral grinding wheels (such as types 1V1, 1K1. 1B1, 1A1 and 12A1), flaring-cup grinding wheels (such as type 11V9) and to face-cup grinding wheels (such as type 11A2, 12A2 and 6A9). The above indicated grinding wheel designations refer to those of the USA Standard Identification Code for Diamond Wheel Shapes, as approved Sept. 2, 1966 by the United States of America Standard Institute. For purposes of clear presentation and to avoid needless redundancy, the invention will be described hereinafter with specific reference to flaring-cup grinding wheels of type 11V9.

BACKGROUND OF THE INVENTION

Abrasive articles such as grinding wheels having an abrasive portion consisting of resin-bonded abrasive particles secured to a support member are known. For example, U.S. Pat. No. 3,389,117 discloses a cup-shaped grinding wheel consisting of an annular abrasive rim member of resin-bonded diamonds adhesively secured to the outermost peripheral edge of a cup-shaped support or backing member of a phenol-formaldehyde resin and an aluminum powder. As indicated in the aforementioned patent, it is necessary when using the cup-shaped grinding wheel to remove some of the backing material adjacent the annular abrasive rim member in order to provide grinding clearance for the abrasive rim element. Such an operation is called "wheel dressing". As further indicated in the aforementioned patent, wheel dressing is a difficult task, especially when the backing member is molded from a mixture of aluminum powder and phenol-formaldehyde resin (primarily because the aluminum of the backing member tends to smear over the surface of the backing member when contacted by the dressing tool). This problem was allegedly overcome in U.S. Pat. No. 3,389,117 by adding a specific alloying element to the backing member thereby to render the backing member readily dressable. In direct contrast to the aforementioned patent, the principal object of the present invention is to provide an abrasive article such as a cup-shaped grinding wheel which avoids or obviates the need for wheel dressing.

THE INVENTION

According to the present invention there is provided an abrasive article comprising a support member having an annular support surface and an annular abrasive member secured to the annular support surface of said support member, wherein said annular abrasive member includes annular resin-bonded abrasive means and an annular back-up member of an abradable porous resin secured to one surface of said annular abrasive means and to the annular support surface of said support member.

DETAILED DESCRIPTION

Figure 1:
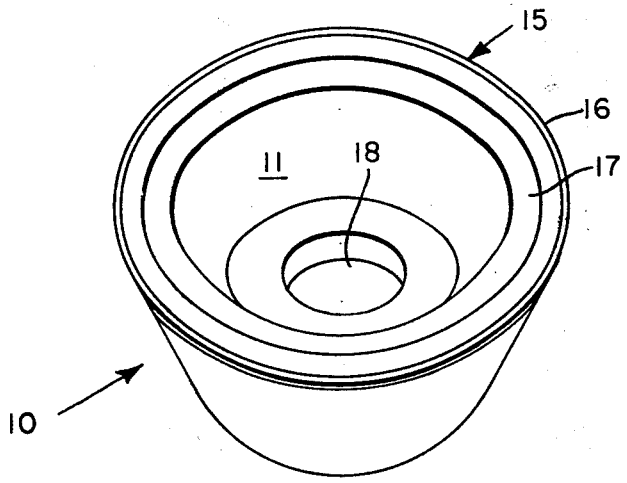
Figure 2:
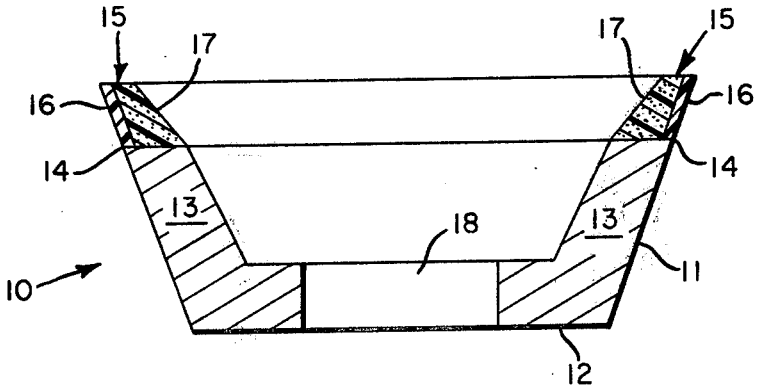

The nature and advantages of the present invention will be more clearly understood by the following description and the several views illustrated in the accompanying drawings wherein like reference characters refer to the same parts throughout the several views and in which:

FIG. 1 is a perspective view of a cup-shaped grinding wheel of the invention; and FIG. 2 is a cross-sectional view of the grinding wheel of FIG. 1.

The grinding wheel 10 herein disclosed in illustration of the invention, as depicted in the accompanying figures, includes support member 11 of generally cup-shaped configuration having a substantially U-shaped cross-section wherein flat section 12 forms the base of the U and outwardly extending section 13 forms the legs of the U. Section 13 of support member 11 terminates in a horizontal plane to provide an annular support surface 14. Support member 11 may be fashioned of any suitable material such as, for example, aluminum. Support member 11 is usually provided with an aperture 18 in the center of section 12 thereof which is useful for mounting the finished grinding wheel on a suitable support member such as a rotatable shaft or arbor.

An annular abrasive member 15 is secured to annular support surface 14 of support member 12 by means of any suitable adhesive such as an epoxy adhesive, e.g., film adhesive HT424 of American Cyanamid. The annular abrasive member 15 comprises annular resin-bonded abrasive means 16 and annular back-up member 17. The annular resin-bonded abrasive means 16 is preferably of diamond abrasive material bonded by a polyimide resin. The annular back-up member 17 is of foamed epoxy or, preferably, of porous polyimide material.

The salient feature of the grinding wheel of the present invention resides in the annular back-up member 17 which is of a frangible or friable nature and, therefore, abrades or wears away as the abrasive means 16 is consumed in use thus obviating the need for wheel dressing. Specifically, back-up member 17 is preferably of porous polyimide material. The back-up member 17 of porous polyimide may be formed by a low pressure-hot molding and sintering method or by a direct forming and free sintering method.

The low pressure-hot molding method entails compacting the polyimide resin at lower than normal pressure, e.g., 3000–5000 psi, and then coalescing the compacted polyimide at temperatures above 300° C. while maintaining the above applied pressure to produce a molded polyimide object having a density less than 92% of the normal density of fully coalesced polyimide resin. The low pressure-hot molding method is substantially as disclosed on page 43 of the Product Licensing Index, November 1970. The direct-forming and free-sintering method (hereinafter referred to as DFS) comprises subjecting a composition of a coalescible polyimide powder and a solid particulate polymer of formaldehyde to a compressive force of at least about 10,000 psi, preferably 100,000 psi, at a temperature preferably about room temperature (25° C.) thereby to provide a preform and thereafter heating the preform to provide a porous polyimide shaped article having interconnecting pores. The heating step both coalesces the polyimide powder in the preform and thermally degrades and depolymerizes the solid particulate polymer of formaldehyde which is evolved in gaseous form thereby leaving voids in the preform to provide a porous polyimide shaped article having interconnecting pores. Thus, the solid particulate polymer of formaldehyde in the composition acts or functions as a fugitive or transient filler which is evolved during the initial heating step.

The heating sequence of the DFS method may preferably be conducted in a step-wise manner as by varying the heating rate of the preform in and through more than one heating cycle. Specifically, it is preferable to heat the preform at a substantially uniform rate from room temperature to about 80° C. by raising the temperature of the preform in increments of 5° C. at 30 minute intervals, and thereafter to continue heating the preform to a temperature of about 150° C. at an incremental heating rate of 7° C. per hour, and thereafter to continue heating the preform at a faster rate, e.g., 1½° C. per minute, to a temperature above about 300° C., preferably about 400° C., and then to maintain the preform at the latter temperature for a suitable period of time such as, for example, three hours. The foregoing heating cycle precludes inadvertent and/or undesired cracking of the preform structure. To illustrate, the solid particulate polymer of formaldehyde decomposes as by depolymerization to gaseous formaldehyde during the initial heating sequence of the method, and release or escape of the formaldehyde gas without containment of the gaseous formaldehyde in the preform is desirable since, otherwise, formaldehyde gas trapped within the preform may develop sufficient pressure during the heating sequence to crack the preform. For this reason, the concentration of the solid particulate polymer of formaldehyde in the composition and preform should be sufficient to provide interconnected pores in the preform which provide suitable pathways for allowing release of the gaseous formaldehyde. The concentration of the solid particulate polymer of formaldehyde in the composition and preform should be sufficient to provide interconnected pores in the preform which provide suitable pathways for allowing release of the gaseous formaldehyde. The concentration of the solid particulate polymer of formaldehyde in the composition and preform should be at least about 5% by weight, based upon the total weight of the composition or preform. Thereafter, the preform is preferably heated to a temperature above about 300° C. to coalesce the polyimide particles and obtain a porous polyimide shaped article.

A salient feature of the DFS process described above is that the solid particulate polymer of formaldehyde pyrolyzes cleanly to formaldehyde gas and is evolved from the preform without leaving a formaldehyde residue therein and without effecting a change in the density of the polyimide phase of the preform which coalesces simultaneously to provide a porous polyimide shaped article. Thus, the pore structure of the polyimide shaped article corresponds substantially identically to the particle size and distribution of the solid particulate polymer of formaldehyde present originally in the preform. The pore size of the porous polyimide shaped article may be regulated as desired by utilizing solid particulate polymers of formaldehyde having varying and/or specific particle size. For example, particulate polymers of formaldehyde of uniform particle size may be used, or mixtures of particulate polymers of formaldehyde of different particle size may be utilized to provide the porous polyimide shaped articles. Paraformaldehyde in the form of commercially available powder consists of solid hard particles having a range of particle sizes with a typical average size of about 20 microns as determined using a commercial micromerograph. This analytical method involves a sedimentation process using a gas as the sedimentation fluid. The particles settle down the sedimentation tube onto a balance pan and a graph of weight versus time is obtained. Through proper calibration, a continuous particle size distribution curve is obtained for particles in the 1 to 250 micron size range. Reference: T. Allan, "Particle Size Measurement", Chapman and Hall, Ltd., London 1968, pg. 99.

The particles of paraformaldehyde are hard and nonporous. Thus, the pores left in the porous polyimide moldings have the size and distribution of the original paraformaldehyde particles in the preforms. The size and distribution of pores and pore volume are thus subject to deliberate control. If larger or smaller pores are desired, the paraformaldehyde powder may be screened to obtain a larger or smaller particle size fraction. Alternately, the smaller particles may be removed by gas elutriation. When larger particles are desired than can be obtained from the paraformaldehyde powder, flake paraformaldehyde may be ground and screened to the desired size. Pore volume is controlled simply by the quantity of paraformaldehyde used in the initial composition.

Suitable solid particulate polymers of formaldehyde include paraform and higher polymers of formaldehyde which are more generally denominated polyacetals and include or are characterized by a linear polymer chain containing recurring—($CH_2O$)—units or groups. The preferred polymer of formaldehyde in the composition is polyoxymethylene which has not been stabilized against thermal degradation as, for example, by end-capping the ends of the linear polymer chain with stabilizing end-groups. Thus, the preferred polymer of formaldehyde is paraformaldehyde, which is a lower molecular weight linear polymer available commercially as a fine powder. Polymers of formaldehyde are described more fully in U.S. Pat. No. 2,768,994 and are sold under the trademark Delrin by E. I. du Pont de Nemours and Company, Inc. Delrin polymers usually have been stabilized against thermal degradation but these polymers may be utilized. Suitable polymers of formaldehyde also include, for example, trioxane. The polymer of formaldehyde comprises up to about 50% by weight of the composition.

The polyimide of annular abrasive means 16 and annular back-up member 17 comprises a coalescible polyimide characterized by the following recurring structural unit:

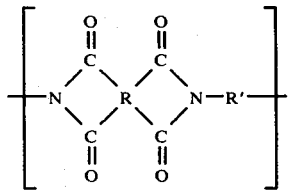

wherein R is a tetravalent aromatic radical containing at least one ring of six carbon atoms characterized by benzenoid unsaturation, the four carbonyl groups of said recurring structural unit being attached to separate carbon atoms in pairs with the carbonyl groups of each pair being attached to adjacent carbon atoms in said R radical; and wherein R′ is a divalent aromatic radical. Suitable polyimides for the method of the present invention are those based upon, for example, pyromellitic dianhydride and 4,4′-oxydianiline or based upon 3,3′,4,4′-benzophenone tetracarboxylic dianhydride and 4,4′-oxydianiline or metaphenylenediamine. Suitable polyimides and powders thereof are more extensively described in U.S. Pat. Nos. 3,179,631 and 3,249,588. The foregoing polyimides may be utilized either singly or in mixtures thereof. The polyimide powder comprises at least 50% by weight of the molding composition when the composition consists of unfilled polyimide and a polymer of formaldehyde.

Suitable fillers such as, for example, silicon carbide, graphite, etc., may be incorporated into the polyimide resin to provide a composition of a filled polyimide and a polymer of formaldehyde.

The principal and practice of the present invention will now be illustrated by the following Example which is exemplary only and it is not intended that the invention be limited thereto since modifications in technique and operation will be apparent to anyone skilled in the art. All parts and percentages specified herein are by weight unless otherwise indicated.

EXAMPLE

An uncapped, granular polyformaldehyde was ground in a pulverizing mill and screened to produce a fraction passing through a No. 60 sieve and being retained on a No. 115 sieve (Tyler Sieve Series) corresponding to particles having a particle size in the range of 124–246 microns. A blend of 74.7 g. of the polyformaldehyde with 86.2 g. of poly-N,N′(4,4′-oxydiphenylene) pyromellitimide containing about 40% by weight of graphite was prepared by dry blending on rolls. The quantity of polyformaldehyde in the blend was 50% by volume.

A disc having a diameter of 4 inches and a thickness of ½-inch was preformed by compacting the blend of polyformaldehyde and polyimide at 50,000 psi, and the preformed disc was subjected to the following thermal cycle in a nitrogen atmosphere:

a. rapid heat-up to 150° C.;
b. slow heat-up to 175° C. at a rate of 5° C./hr.;
c. isothermal heating at 175° C. for 16 hours;
d. rapid heat-up to 200° C.;
e. isothermal heating at 200° C. for 30 minutes;
f. cooling to room temperature;
g. heating to 400° C. at a rate of 1½° C./minute;
h. isothermal heating at 400° C. for 3 hours; and
i. cooling to room temperature.

The disc was machined into a back-up insert for a 3¾ inch 11V9 flaring-cup grinding wheel of the construction shown in FIGS. 1 and 2. The grinding wheel was assembled by applying a film adhesive (HT424-American Cyanamid) between porous polyimide back-up member 17 and a polyimide-bonded diamond abrasive rim 16 and pressing the members together at a pressure of about 80 psi and a temperature of about 177° C. for a period between 40 and 60 minutes. The resulting annular abrasive member 15 was secured to support member 11 of aluminum by applying the film adhesive (HT424) between annular support surface 14 and annular abrasive member 15 and pressing the members together at a pressure of about 80 psi and a temperature of about 177° C. for a period of between 40 and 60 minutes.

The flaring-cup grinding wheel was used to grind tungsten carbide blocks, and during use the porous polyimide back-up or insert wore away as the diamond abrasive rim was consumed without having to interrupt the grinding operation for machining or dressing the back-up or insert member.

What is claimed is:

1. An abrasive article comprising a nonabrasive support member having an annular support surface and an annular abrasive member adhesively secured directly to the annular support surface of said support member, wherein said annular abrasive member includes annular resin - bonded abrasive means so constructed and arranged as to provide the outer peripheral surface of said annular abrasive member and having an annular abrading surface, and an annular back-up member of a frangible and abradable porous polyimide resin secured to the inside surface of said annular abrasive means and to the annular support surface of said support member, said annular back-up member having an annular surface terminating in a plane coextensive with the annular abrading surface of said annular resin-bonded abrasive means, whereby said annular surface of said annular back-up member is adapted to abrade and wear away when said annular abrading surface of said annular resin-bonded abrasive means is consumed in use.

2. The abrasive article of claim 1 wherein the resin of said annular resin-bonded abrasive means is a polyimide resin.

3. A self-dressing abrasive grinding wheel having an annular abrasive surface comprising a nonabrasive support member; an annular resin-bonded abrasive member adhesively secured directly to said support member; and an annular nonabrasive back-up member of an abradable porous polyimide resin secured to said annular resin-bonded abrasive member and to said nonabrasive support member, said backup member terminating in a surface coextensive with said abrasive surface.

* * * * *